US005509168A

United States Patent [19]

Butler et al.

[11] Patent Number: 5,509,168

[45] Date of Patent: Apr. 23, 1996

[54] DEVICE FOR EXTENDING THE EFFECTIVENESS AND LIFE OF A TOOTHBRUSH

[76] Inventors: C. P. Butler, P.O. Box 870927, Stone Mountain, Ga. 30087; F. M. Butler, 3118 SW. 20th Ter., Del Ray Beach, Fla. 33445

[21] Appl. No.: 341,359

[22] Filed: Nov. 17, 1994

[51] Int. Cl.[6] ..... A46B 17/04

[52] U.S. Cl. ..... 15/257.01; 15/168; 15/184; 15/246; 24/543; 24/562; 132/308; 206/362.3

[58] Field of Search ..... 15/167.1, 168, 15/184, 185, 246, 257.01; 24/500, 501, 543, 562; 132/308; 206/209, 209.1, 361, 362.2, 362.3

[56] References Cited

U.S. PATENT DOCUMENTS

| | | | |
|---|---|---|---|
| 1,960,807 | 5/1934 | Cole | 15/185 |
| 2,608,293 | 8/1952 | Carlson | 15/185 |
| 2,620,500 | 12/1952 | Ridner, Sr. | 15/184 |
| 2,897,531 | 8/1959 | Calabrese | 15/257.01 |
| 2,947,412 | 8/1960 | Tupper | 15/184 |
| 3,120,019 | 2/1964 | Scott | 15/184 |
| 3,127,985 | 4/1964 | Scott | 15/184 |
| 3,665,563 | 5/1972 | Batts | 24/543 |
| 4,237,579 | 12/1980 | Salmon | 15/246 |
| 4,844,311 | 12/1989 | Gregory | 15/167.1 |
| 5,042,107 | 8/1991 | Gregory et al. | 15/257.01 |
| 5,315,733 | 5/1994 | Ledingham | 15/168 |

FOREIGN PATENT DOCUMENTS

| | | | |
|---|---|---|---|
| 36986 | 8/1930 | France | 206/209 |
| 241090 | 5/1911 | Germany | 15/184 |
| 568726 | 11/1957 | Italy | 24/500 |
| 92-09217 | 6/1992 | WIPO | 24/543 |

*Primary Examiner*—mark Spisich
*Attorney, Agent, or Firm*—Deveau, Colton & Marquis

[57] ABSTRACT

A dental oral hygiene device for extending the useful lifetime of a toothbrush having a handle and a plurality of longitudinal bristles, the bristles having a defined length and being attached generally normal to the handle and forming a generally rectilinear array, each of the bristles having a proximal end attached to the handle and a distal end forming a tip, the device including a structure for applying pressure to the bristles at at least two points along the bristle length, preferably approximately at the bristle tip and at a point between the bristle tip and the proximal end of the bristle, a receptacle structure supporting the structure for applying pressure and for containing at least a portion of the toothbrush including the bristles, wherein the bristles are forced generally inwardly such that the rectilinear array is generally maintained and the bristles are prevented from splaying outwardly relative to each other.

3 Claims, 3 Drawing Sheets

DEVICE FOR EXTENDING THE EFFECTIVENESS AND LIFE OF A TOOTHBRUSH

BACKGROUND OF THE INVENTION

1. Field of the Invention

The present invention relates generally to the field of oral hygiene and more specifically to a device that places pressure on the bristles of a toothbrush such that the device aligns and straightens the bristles to reverse and prevent splaying, such that the toothbrush is effective and useful for a longer period of time.

2. Prior Art

In the daily practice of oral hygiene over extended periods of time, the bristles of a toothbrush become deformed such that the bristle ends splay in various directions. Also, over time, the toothbrush becomes increasingly unsatisfactory to use as the toothbrush bristles do not present a united front to the area to be brushed. As the bristles deform and splay, the toothbrush loses a measure of effectiveness in cleaning the teeth and gums, and irritation and ulcers may result to the mouth's soft gum tissue. New toothbrushes can become significantly splayed in less than one month. However, most people continue to use their toothbrush long after its original shape has been altered by use and its effectiveness diminished. Because toothbrush bristles are made of thin plastic material, subject to bending, splaying bristles is a normal occurrence.

Various devices have been developed to attempt to protect and/or shape the bristles of a toothbrush. None of the prior art has been found to meet the specific needs to which the present invention is directed. For example, U.S. Pat. No. 1,960,807 to Cole discloses a toothbrush with an integrated retractable hood to cover the toothbrush head to protect it from contamination. U.S. Pat. No. 2,608,293 to Carlson also discloses a toothbrush with an attached slidable protective casing for the toothbrush head to protect it from contamination Neither of these two inventions were developed to act upon the bristle in a positive manner.

Other devices have been developed to attempt to maintain the toothbrush bristles in an upright position when in use. U.S. Pat. No. 2,620,500 to Ridner, Sr. discloses a combination toothbrush and protective case having upright walls forcing the bristles of the enclosed toothbrush to remain upright. U.S. Pat. No. 3,120,019 to Scott discloses a combination toothbrush clamp and cover, also having upright walls that close over the toothbrush bristles, forcing them into an upright position. U.S. Pat. No. 3,127,985 to Scott discloses a protective case for the head of a toothbrush, having walls which angle slightly inward at their tops to act on the splayed bristle tips. None of these three devices act on the entire bristle length to maintain the bristle in its manufactured configuration. Likewise, none of these three devices positively act on the entire bristle to reform the bristle after it has splayed, with the result being that the bristles remain splayed to a large extent.

Still other devices have been developed to positively act on the toothbrush bristles. U.S. Pat. No. 2,897,531 to Calabrese discloses a sleevelike clamp to position the toothbrush bristles while drying. While the Calabrese device may force the bristles slightly inwardly, it does not have a suitable structure for aligning the bristles. In effect, the Calabrese device first does not act on the bristle tips and second does not prevent the bristles from remaining in an improper position along the length of the toothbrush head.

U.S. Pat. No. 4,884,311 to Gregory discloses a spring clamp for reforming toothbrush bristles. The clamp is positioned at a preselected height down from the free ends, or tips, of the bristles such that the bristles are reformed to flare outward so that they can scour trader the gum flap. This clamp does not apply graduated pressure to the bristles. As well, the clamp's desired intention is to alter the configuration of the bristles such that the bristles flare outward instead of forming in a vertical position, as manufactured. The resulting bristle shape is exactly what the present invention tries to avoid.

U.S. Pat. No. 5,042,107 to Gregory, et al., a continuation of U.S. Pat. No. 4,884,311, discloses a cover with compression means to reform toothbrush bristles. Again, the clamp is positioned at a preselected height down from the free ends, or tips, of the bristles such that the bristles are reformed to flare outward so that they can scour under the gum flap. This clamp does not apply graduated pressure to the bristles. As well, the clamp's desired intention also is to alter the configuration of the bristles such that the bristles flare outward instead of forming in a vertical position, as manufactured. Again, the resulting bristle shape is exactly what the present invention tries to avoid.

The Gregory devices create a flared bristle toothbrush. Flared bristles may irritate the gums and mouth walls. Flared bristles also deviate from the manufactured shape and structure of the new toothbrush. Further, the Gregory devices only act on a single defined portion of the bristles slightly down from the bristle tips, and not on the entire bristles. The Gregory devices also act on the bristles in such a manner to force them inward, but do not have means to align the bristles relative to each other.

Although the prior art discloses various devices to cover and reposition toothbrush bristles, none discloses a device which applies graduated pressure to strategic points along substantially the entire length of the toothbrush bristles so that the original shape of the bristles and the effectiveness of the toothbrush is maintained, and to maintain the bristles in an alignment and shape as close to the alignment and shape of a new toothbrush. Thus, it can be seen that there is a need for a device for extending the useful life and effectiveness of a toothbrush which maintains the toothbrush bristles in as close to the as-new shape as possible.

BRIEF SUMMARY OF THE INVENTION

The present invention is a clamp or clip-like device which both reverses splaying and aligns the bristles of a toothbrush. The device comprises two cooperating complimentary halves connected by a hinge, and a means for maintaining the two halves in a dosed, pressure inducing relationship. The two halves, which are substantially identical to each other, each comprise an area for receiving and acting on the toothbrush, a throat or hinge area, and a handle. The area for receiving and acting on the toothbrush is generally hollow and comprises a plurality of pressure inducing and bristle aligning surfaces, preferably in the form of horizontal parallel rows of teeth.

For adult toothbrushes, three sets of opposing pressure/aligning surfaces are preferred, each half having one member surface of each of the three sets. For child toothbrushes, only two sets of opposing pressure/aligning surfaces are preferred due to the smaller size of a child toothbrush. One device, having three sets of opposing pressure/aligning surfaces is capable of being used on all sizes of toothbrushes. For the adult toothbrush, all three pressure/aligning surfaces are employed, while for the child toothbrush, only the two lowermost pressure/aligning surfaces are employed.

Each set of opposing/aligning surfaces act on a different area of the toothbrush bristles. For an adult toothbrush, the first set acts on the bristles nearest or proximal to the toothbrush handle, the second set acts on approximately the midpoint of the bristles' length, and the third set acts on the bristles' tips farthest or distal from the toothbrush handle. For a child toothbrush, the first set acts on the bristles nearest or proximal to the toothbrush handle, the second set acts on the bristles' tips farthest or distal from the toothbrush handle, and the third set does not contact the bristles. The proximal pressure/aligning surfaces produce the least amount of pressure on the bristles, and the distal pressure/aligning surfaces produce the most amount of pressure on the bristles, resulting in a graduated pressure being applied to the bristles. This graduated pressure serves a dual purpose. First, as the bristles generally splay more at the bristle tips, more pressure is need to create the histeresis to reform the bristles. Second, the graduated pressure refoms the bristles to more closely resemble the bristles of a new toothbrush.

The pressure/aligning surfaces are parallel to each other relative to the longitudinal axis of the toothbrush handle, and parallel to the longitudinal axis of the toothbrush handle itself and, therefore, normal to the original position of the bristles. The pressure/aligning surfaces preferably have teeth into which the bristles fit. The pressure is applied to the bristles by the pressure/aligning surfaces in an inward and downward direction in an amount sufficient to effect histeresis on the bristles, reversing the splaying. The teeth help maintain the bristles upright relative to each other and the toothbrush head.

It is an object of the present invention to provide a device which reverses the splaying of toothbrush bristles caused by use.

It is another object of the present invention to provide a device which increases the useful life and effectiveness of a toothbrush.

Yet another object of the present invention is to provide a device which reshapes and realigns the splayed bristles of a used toothbrush to a shape and alignment similar to a new toothbrush.

A further object of the present invention is to provide a device which stores and contains a toothbrush while at the same time reshapes and realigns the splayed bristles of a used toothbrush.

Still another object of the present invention is to provide a device which prevents the splaying of the bristles of a toothbrush.

These objects, and other objects, features and advantages of the present invention, will become more apparent to one skilled in the art when the following detailed description of the preferred embodiments is read in conjunction with the appended drawings, in which like reference numerals designate like parts throughout the several views.

DETAILED DESCRIPTION OF THE PREFERRED EMBODIMENTS

Figure 1:
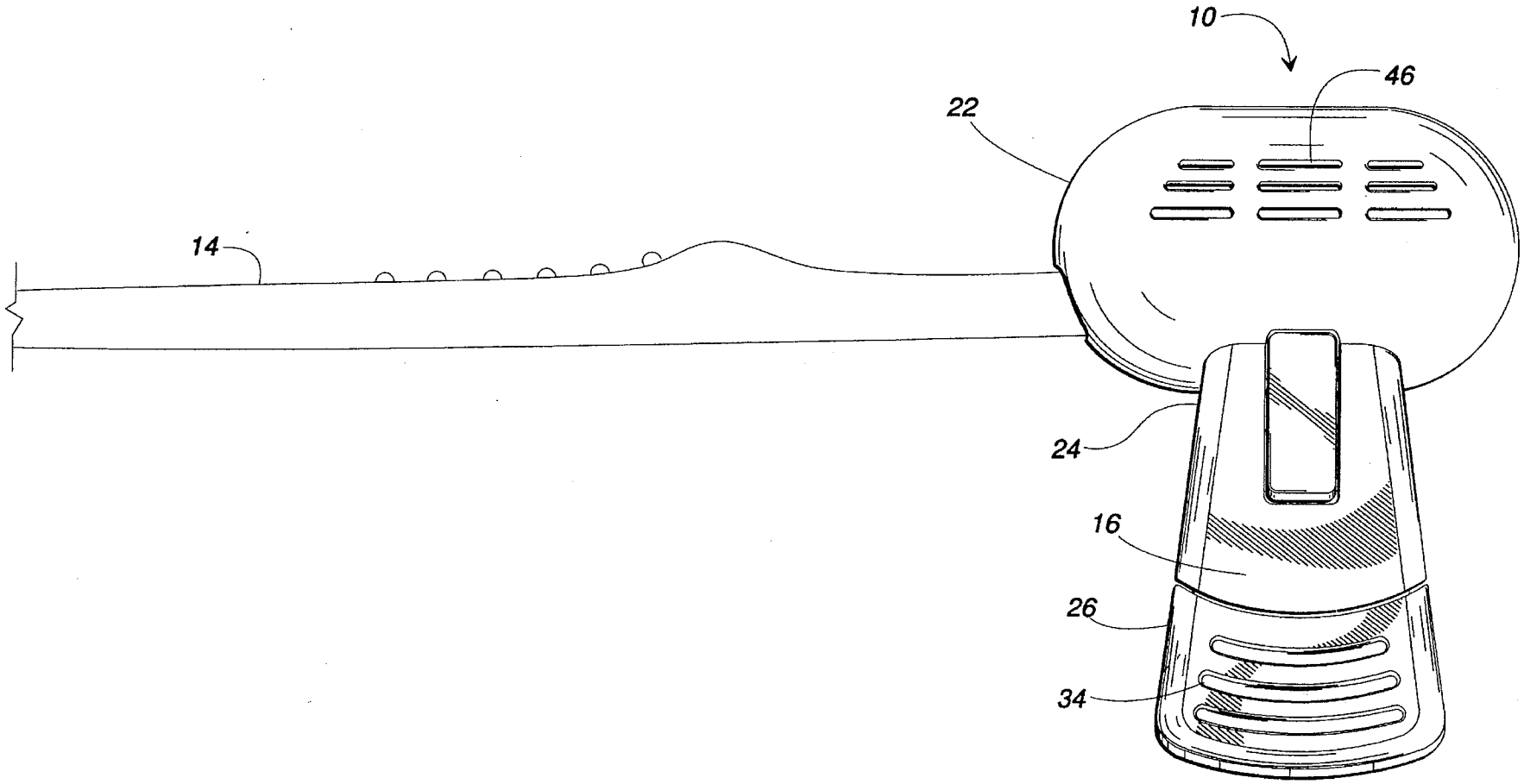
FIG. 1 is a perspective side view of the device illustrated with a toothbrush enclosed.

The present invention is a mechanism that places pressure on the bristles of a toothbrush to align and straighten the toothbrush bristles and to prevent the splaying which has a tendency to occur after brushing briskly and/or over a period of time. Splaying of the toothbrush bristles can cause irritation and ulcers. The device, which fits on both manual and electric toothbrushes, allows the toothbrush to last longer by retaining its shape, to be protected from airborne bacteria, and to be more effective for the life of the toothbrush. One size fits both adult- and child-sized toothbrushes. The device also keeps the brush from resting directly on a cottoter or other types of surfaces to prevent contamination of both the toothbrush and the surface.

Referring now to the Figs., the preferred embodiment of the present invention is a clamp or clip-like device 10 which both reverses splaying and aligns the bristles 12 of a toothbrush 14. The device 10 comprises two cooperating complimentary structural halves **16*a*, 16*b* connected by a hinge 18, and a pressure-creating means 20 for maintaining the two halves 16 in a closed, pressure inducing relationship. The two halves 16, which are substantially identical to each other, each comprise a hollow area 22 for receiving and acting on the toothbrush 14, a throat or hinge area 24, and a handle 26. The hollow area 22 for receiving and acting on the toothbrush comprises a plurality of pressure inducing and bristle aligning surfaces 28, preferably in the form of rows of teeth 30**.

Figure 3:
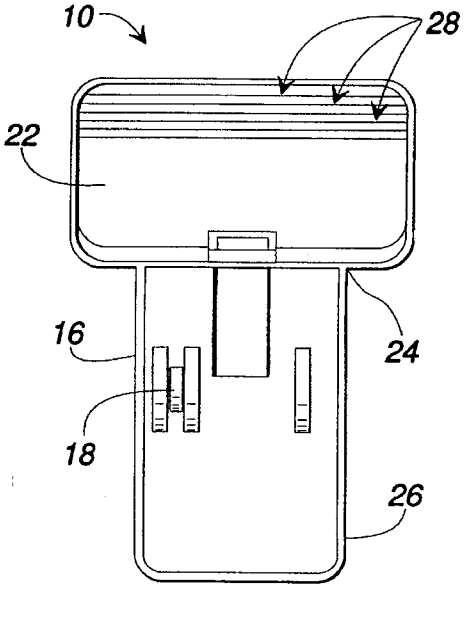
FIG. 3 is a front view of the interior of the device depicted in FIG. 2.
Figure 2:
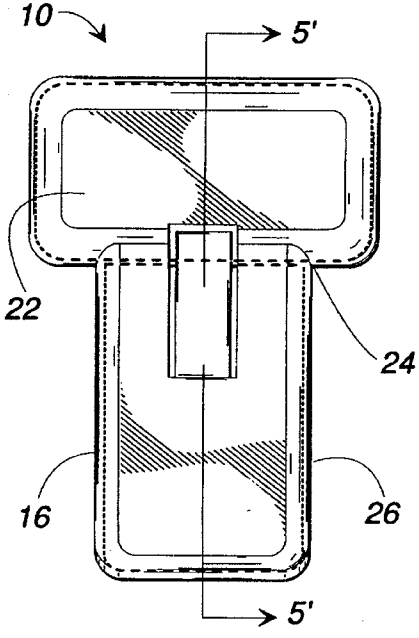
FIG. 2 is a from view of the exterior of the device depicted in FIG. 1.

Referring now to FIGS. 2 and 3, the halves 16 are shown in more detail. Each half comprises the hollow area 22, the handle 26 and the throat or hinge area 24 located between and connecting the hollow area 22 to the handle 26. The two halves **16*a*, 16*b* are hingedly connected to each other via a hinge 18, such that the hollow area 22*a* of the first half 16*a* is opposite to the hollow are 22*b* of the second half 16*b*, and the handle 26*a* of the first half 16*a* is opposite to the handle 26*b* of the second half 16*b*. Each handle 26 preferably has a rubberized grip on the outside surface 34 to help prevent the device 10 from slipping out of the user's hand during use. Each throat or hinge area 24 has a hinge half 36*a*, 36*b* extending inwardly from the inner surface 38. The two hinge halves 36*a*, 36*b* are pivotally connected to each other to create a unitary device 10**.

Figure 4:
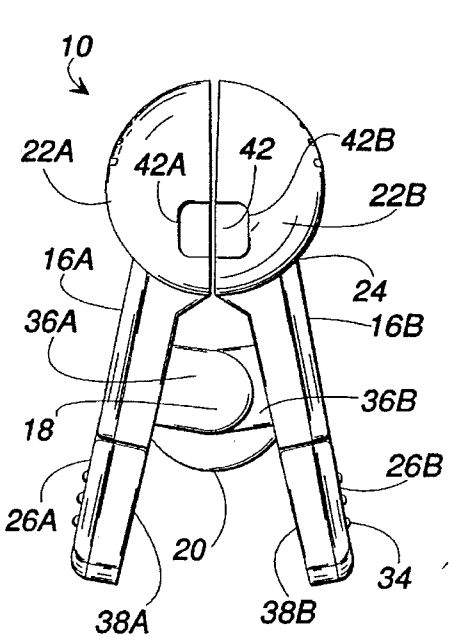
FIG. 4 is a side view of the exterior of the device.
Figure 9:
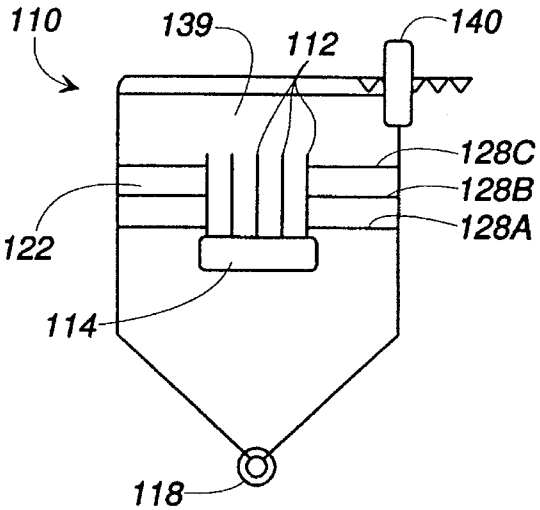
FIG. 9 is a side view of an alternative embodiment of the device incorporating a hinge and ratchet mechanism.

A pressure creating means 20, such as the spring shown in FIG. 4, is located between the two halves 16, forcing the handles 26 apart from each other and the hollow areas 22 toward each other in a manner similar to a clothes pin. The pressure creating means 20 is designed to produce enough pressure to reform the bristles 12 to remove splaying when the bristles 12 are clamped between opposing pressure/aligning surfaces 28 as discussed in more detail below. Whether the pressure creating means 20 is a spring as shown in FIG. 4 or a tooth and ratchet mechanism as shown in FIG. 9, the pressure creating means 20 is designed to effect histeresis in the splayed bristles 12.

Each hollow area 22 has a generally batholithic shape with the horizontal or longitudinal axis, that is the axis parallel to the toothbrush handle 14 axis, being longer than the vertical or latitudinal axis, that is the axis perpendicular to the toothbrush handle 14. The two hollow areas 22 cooperate to form a generally barrel shaped structure with a hollow interior 39. In use, the pressure creating means 20 forces the two halves 16 together to create the closed blimp shaped structure. The handles 26 are squeezed together to separate the first hall 16*a* from the second hall 16*b*, allowing access to the hollow interior 39. One end of each half 22 has a port 42*a*, 42*b*. The ports 42 cooperate with each other when the device 10 is closed to allow the handle of the toothbrush 14 to extend out of the device 10, as best shown in FIG. 1.

Figure 5:
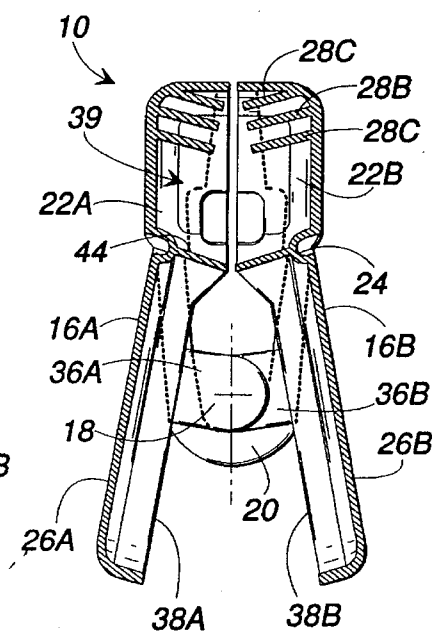
FIG. 5 is a sectional side view of the device depicted in FIG. 2 along line 5'—5'.

The pressure/aligning surfaces 28 are integrally attached to the interior walls 40 of the two halves 16 parallel to the longitudinal axis of the two halves 16, as best shown in FIG. 5. The pressure/aligning surfaces 28 are located parallel to each other within the hollow interiors of the halves 16 in positions allowing, as best shown in FIG. 9, the proximal pressure/aligning surfaces 28*a* to contact the bristles 12 close to the toothbrush handle 14, the middle pressure/aligning surfaces 28*b* to contact the middle of the bristles 12 of an adult toothbrush 14 or the tips of a child toothbrush 14, and the distal pressure/aligning surfaces 28*c* to contact the tips of an adult toothbrush 14 or to contact nothing or each other if a child toothbrush 14 is being reformed.

For an adult toothbrush 14, three sets of opposing pressure/aligning surfaces 28*a*, 28*b*, 28*c* are preferred, with the first half 16*a* having one pressure/aligning surface 28 of each of the three sets and the second half 16*b* having the complimentary pressure aligning surfaces 28. For a child toothbrush 14, only two sets of the opposing pressure/aligning surfaces 28 are preferred due to the smaller size of a child toothbrush 14. One device 10, having three sets of opposing pressure/aligning surfaces 28 is capable of being used on all sizes of toothbrushes 14. For the adult toothbrush 14, all three pressure/aligning surfaces 28*a*, 28*b*, 28*c* are employed, while for the child toothbrush 14, only the two lowermost pressure/aligning surfaces 28*a*, 28*b* are employed.

As shown in FIG. 9, each set of pressure/aligning surfaces 128 act on a different area of the toothbrush bristles 112. For an adult toothbrush 14, the first set of pressure/aligning surfaces 128*a* acts on the bristles 112 nearest or proximal to the toothbrush handle 114, the second set of pressure/aligning surfaces 128*b* acts on approximately the midpoint of the bristles' 112 length, and the third set of pressure/aligning surfaces 128*c* acts on the bristle 112 tips farthest or distal from the toothbrush handle 114. For a child toothbrush 114, the first set of pressure/aligning surfaces 128*a* acts on the bristles 112 nearest or proximal to the toothbrush handle 14, the second set of pressure/aligning surfaces 128*b* acts on the bristle 112 tips farthest or distal from the toothbrush handle 114, and the third set of pressure/aligning surfaces 128*c* does not contact the bristles 112.

When the device 10 is closed, opposing pressure/aligning surfaces 28 cooperate with each other to reform the bristles 12. As can be seen in FIGS. 5 and 9 (with reference to FIG. 9, the prefix 1 may be added to the corresponding two digit reference numerals throughout the Specification to refer to the correct component in FIG. 9), opposing pressure/aligning surfaces 28 do not actually contact each other, but there is a measurable space between them. The measurable space between opposing pressure/aligning surfaces 28 is graduated, with the smallest space being between opposing pressure aligning surfaces 28*a*. As discussed below, the graduated measurable space between opposing pressure/aligning surfaces 28 creates a graduated pressure along the length of the bristles 12.

The various sets of pressure/aligning surfaces 28 produce different amounts of pressure on the bristles 12. The proximal pressure/aligning surfaces 28*a* produce the least amount of pressure on the bristles 12, and the distal pressure/aligning surfaces 28*c* produce the most amount of pressure on the bristles 12, resulting in a graduated pressure being applied to the bristles 12. This graduated pressure serves a dual purpose. First, as the bristles 12 generally splay more at the bristle 12 tips, more pressure is need to create the histeresis to reform the bristles 12. Second, the graduated pressure refoms the bristles 12 to more closely resemble the bristles 12 of a new toothbrush 14.

Figure 7:
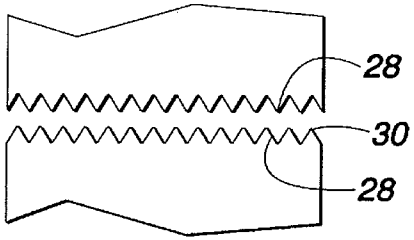
FIG. 7 is a top view of a pair of opposing pressure/alignment surfaces of the device.
Figure 6:
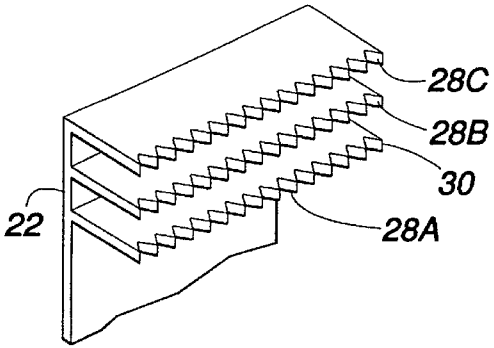
FIG. 6 is a perspective side view of a set of three pressure/alignment surfaces of the device.
Figure 8:
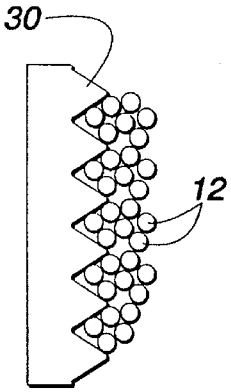
FIG. 8 is a top view of a pressure/aligning surface depicted in FIG. 6 illustrated with toothbrush bristles.

Referring now to FIGS. 6, 7 and 8, the pressure/aligning surfaces 28 are parallel to each other relative to the longitudinal axis of the toothbrush handle 14 and to the longitudinal axis of the toothbrush handle 14 itself and, therefore, normal to the original position of the bristles 12. The pressure/aligning surfaces 28 preferably have teeth 30 into which the bristles 12 fit. The pressure applied is to the bristles 12 by the pressure/aligning surfaces 28 in an inward and downward direction in an amount sufficient to effect histeresis on the bristles 12, reversing the splaying. The teeth 30 help maintain the bristles 12 upright relative to each other and the toothbrush 14 head.

Figure 10:
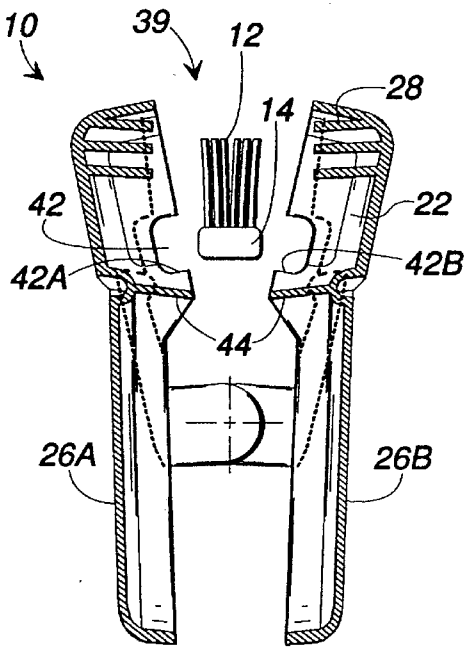
FIG. 10 is a sectional side view of the device shown in its open position illustrated with toothbrush bristles.

In use, the toothbrush 14 is inserted into the opened device, as shown in FIG. 10. The device is opened by applying pressure to the handles 26*a*, 26*b*. The handle of the toothbrush 14 extends externally from the device 10 through port 42, formed by port halves 42*a*, 42*b* when the device is closed. The toothbrush 14 head and bristles 12 remain within the hollow interior 39 of the device 10. The toothbrush may rest on the lower surface 44 of the interior wall of the device 10. Releasing the pressure on the handles 26*a*, 26*b* allows the device 10 to close. Halves 22 come together with the toothbrush 14 head and bristles 12 within the hollow interior 39, the bristles 12 being clamped between pressure/aligning surfaces 28 to reverse the splaying caused by use.

The opposing pressure/aligning surfaces 28 impart an inward and slightly downward force to the bristles 12. As can be seen best in FIG. 5, when the device 10 is closed, the opposing pressure/aligning surfaces 28 angle slightly downward. It has been found that this slight angle provides the best results because, as can be seen best in FIG. 9, pressure/aligning surfaces 28 will contact bristles 12 at approximately a 90° angle, which allows the transfer of the most pressure from the pressure/aligning surfaces 28 to the bristles 12.

Pressure creating means 20 creates a sufficient amount of pressure which is transferred to the bristles 12 through the pressure/aligning surfaces 28. Any pressure creating means 20 is appropriate, including but not limited to springs, tension wires, spring steel, clamps, and the like. The device 10 can be made in a number of different sizes, depending on the type of toothbrush used. However, as mentioned previously, the device 10 can be dimensioned to work on the majority of commercial toothbrushes, both manual and automated. It has been found that teeth 30 of approximately 0.050"– 0.070" in height and 0.060"–0.080" apart give the best results. The teeth 30 height and frequency are a function of bristle 12 size and amount and one skilled in the art easily can determine the proper size and spacing.

Referring now to FIG. 9, an alternative embodiment of the device 10 is shown. This embodiment does not have handles 26 or a spring, but relies on a ratchet device 140 to create the required pressure on the bristles 12 and to hold the device 110 closed. After the toothbrush 14 is placed within the hollow interior 39 of the device 110, the halves 22 are closed, clam shell like, and secure together via ratchet device 140. Ratchet device 140 may be any typical ratchet or toothed device known. Reforming pressure is created by squeezing the halves together and locking them in place via the ratchet device 140.

The device 10 preferrably has air circulation vents 46 allowing air to circulate from the ambient through the hollow interior 39. Sufficient air circulation assists in the drying of the toothbrush and helps prevent the growth of harmful bacteria within the device 10. Handles 26 also allow the toothbrush 14 to be supported off a surface 48, such as a counter top, also helping to prevent contamination of the toothbrush 14. In this manner, the device 10 also can double as a carrying case for the toothbrush 14 which protects the toothbrush 14 and reforms splayed bristles 12 at the same time.

The preferred embodiment described above are for illustrative purposes only and are not intended to limit the scope of the invention or its equivalents, as defined in the appended claims.

What is claimed is:

1. A dental oral hygiene device for extending the useful lifetime of a toothbrush having a handle and an elongated plurality of longitudinal bristles each having a defined length attached generally normal to the longitudinal axis of the handle and forming a generally rectilinear bristle array, each of the bristles having a proximal end attached to the handle and a distal end forming a tip, said device comprising:

a. means for applying pressure to opposite sides of the bristle array at at least two points along the bristle length, said at least two points including a point approximately at the bristle tip and at a point between the bristle tip and the proximal end of the bristle;

b. a receptacle structure supporting said means for applying pressure and for containing at least a portion of the toothbrush including the bristles;

wherein said means for applying pressure comprises a pair of clamping members each including a plurality of clamping surfaces, wherein each clamping surface on one of said members has a corresponding cooperating clamping surface on the other said member said clamping surfaces being substantially parallel to the toothbrush handle when in use, each of said cooperating clamping surfaces interacting with the bristles and the distance separating said cooperating clamping surfaces at said point between the bristle tip and proximal end of the bristle is greater than the distance separating said cooperating clamping surfaces at said point at approximately the bristle tip.

2. The device as claimed in claim 1, wherein said receptacle structure comprises a first half and a second half, each of said first half and said second half include a respective plurality of said cooperating clamping surfaces.

3. The device as claimed in claim 2, wherein said first half and said second half of said receptacle structure define a substantially enclosed hollow volume therebetween.

* * * * *